United States Patent [19]

Kammerer et al.

[11] Patent Number: 4,817,315

[45] Date of Patent: Apr. 4, 1989

[54] THREE-DIMENSIONAL DISPLAY DEVICE FOR LAMPSHADES

[76] Inventors: Brian G. Kammerer; Glenda M. Kammerer, both of 220 Gerdes Rd., New Canaan, Conn. 06840

[21] Appl. No.: 52,575

[22] Filed: May 20, 1987

[51] Int. Cl.[4] ..... G09F 13/00

[52] U.S. Cl. ..... 40/554; 40/441

[58] Field of Search ..... 40/554, 441

[56] References Cited

U.S. PATENT DOCUMENTS

| | | | |
|---|---|---|---|
| 1,524,627 | 1/1925 | Meurer | 40/441 |
| 1,728,166 | 9/1929 | Horton | 40/441 |
| 2,177,209 | 10/1939 | Burickehl | 40/554 |
| 2,204,435 | 6/1940 | Musaphia | 40/441 |
| 2,823,477 | 2/1958 | Willard | 40/554 |
| 2,876,339 | 3/1959 | Thourne | 40/441 |
| 2,974,435 | 3/1961 | Eschenroeder | 40/554 |
| 3,121,417 | 2/1964 | Goldman et al. | 40/160 |
| 3,456,106 | 7/1969 | Gluschkin | 40/554 |

*Primary Examiner*—Paul J. Hirsch

*Attorney, Agent, or Firm*—F. Eugene Davis, IV

[57] ABSTRACT

The present invention provides a decorative lamp for displaying three dimensional works of art, photographs, and the like. A frustoconical lampshade formed from a non-translucent material has an opening cut from it to provide a viewing aperture. A first translucent panel having an art motif or other suitable design on it is affixed to the inside of the lampshade and covers the opening. The curvature of the first panel corresponds to the curvature of the lampshade. Additional translucent panels containing artwork complimenting that on the first panel are mounted concentrically within the lampshade at predetermined distances apart from the first panel to create a three dimensional effect. The inner panels are configured in a frustoconical shape to conform to the general configuration of a standard lampshade. The artwork contained on these inner panels is pre-distorted to avoid distortion in the final display that would otherwise result from the frustoconical configuration of the lampshade and the viewing aperture cut from the lampshade.

21 Claims, 3 Drawing Sheets

FIG. 1
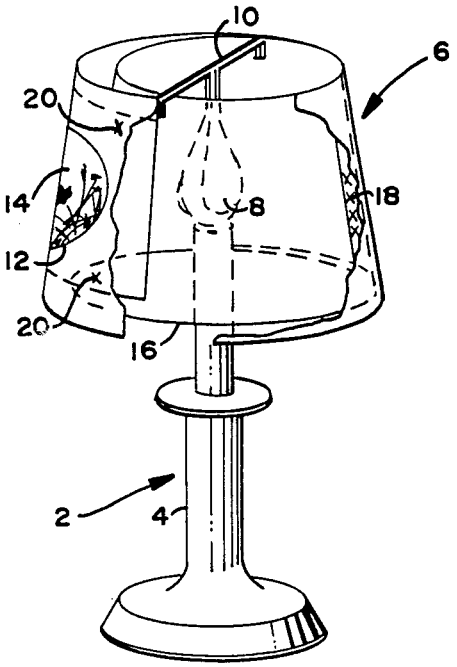
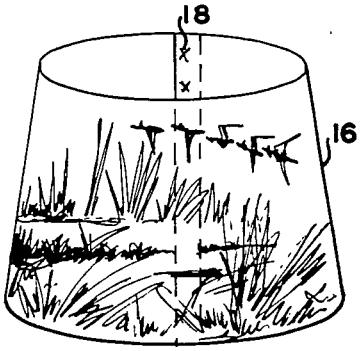
FIG. 3
FIG. 2
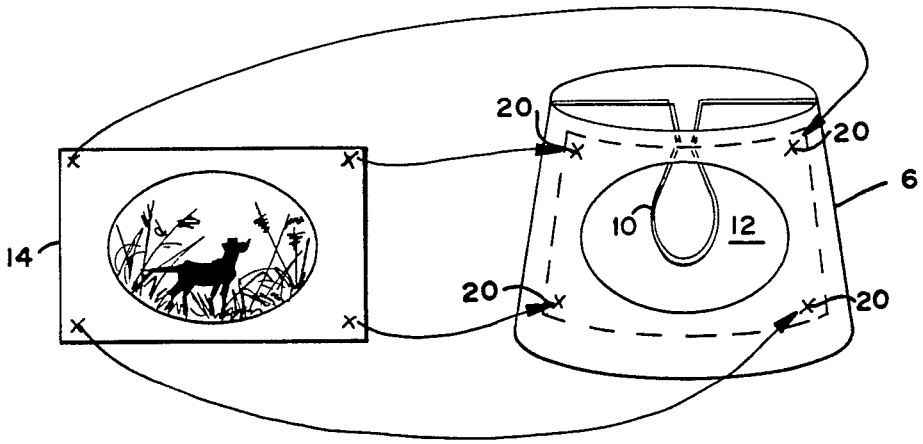

THREE-DIMENSIONAL DISPLAY DEVICE FOR LAMPSHADES

DISCUSSION OF THE BACKGROUND ART

The present invention is directed to decorative lamps, and particular, lamps including window displays for viewing works of art to provide a three-dimensional viewing effect and to eliminate distortion resulting from the frustoconical configuration of standard lampshades.

Lamps and other devices used to display artwork or photographic material are generally known to the art. For example, the following United States patents disclose display devices in which one-dimensional artwork or photographs are inserted into a lampshade having a window opening to provide an illuminated display: U.S. Pat. No. 2,680,317 issued to Lewis on June 8, 1954; U.S. Pat. No. 2,702,492 issued to Cline on Feb. 22, 1955; U.S. Pat. No. 2,823,477 issued to Willard on Feb. 18, 1958; and U.S. Pat. No. 3,456,106 issued to Gluschkin on July 15, 1969. Examples of known devices for providing illuminated and/or three-dimensional displays are illustrated by the following patents: U.S. Pat. No. 2,026,713 issued to Terwilliger on Jan. 7, 1936; U.S. Pat. No. 1,244,959 issued to Conover on Oct. 30, 1917; U.S. Pat. No. 636,319 issued to Camp on Nov. 7, 1899; U.S. Pat. No. 1,499,891 issued to Storer on July 1, 1924; U.S. Pat. No. 2,577,320 issued to Fenyo on Dec. 4, 1951; U.S. Pat. No. 3,829,998 issued to Flax on Aug. 20, 1974; and U.S. Pat. No. 4,438,579 issued to Engel on Mar. 27, 1984.

U.S. Pat. No. 2,565,553 issued to Foley on Aug. 28, 1951 discloses a three-dimensional picture device which is suitable for use in various types of advertising or other displays, and in various articles such as lamps and lampshades. When used in a lampshade, the device includes a transparent window or viewing section defined on the surface of the lampshade, and a plurality of picture sheets mounted within the lampshade and spaced apart from each other to provide a three-dimensional effect when viewed as a composite through the window. The picture sheets are curved in a direction opposite to the curvature of the surface of the lampshade and thus are not concentrically mounted with respect to the lampshade. Additionally, the lampshades disclosed in the Foley patent are uniformly cylindrical in cross section and thus Foley does not recognize or address the problem of distortion of a three-dimensional image resulting from a lampshade having a frustoconical configuration.

It is the primary object of the present invention to provide a three-dimensional illuminated display device for a lamp having a standard frustoconical configured lampshade in which the components forming the three dimensional images are designed and mounted to reduce or eliminate distortion in the final three-dimensional composite display.

It is a further object of the invention to provide a generally improved display device utilizing a frustoconical lampshade to provide an improved composite image enhancing a three-dimensional effect.

SUMMARY OF THE INVENTION

A device for providing an illuminated three-dimensional display includes a standard frustoconical configured lampshade. A section of desired size and shape is cut from the lampshade to define a window or viewing aperture, and a first frame of translucent material containing art work or a photograph is affixed to the inner surface of the lampshade and covers the window opening. This first frame is curved to conform identically to the curvature of the portion of the lampshade to which it is mounted. At least one further frame containing additional artwork or photographs is mounted within the lampshade. The additional frame is spaced a predetermined distance apart from the first frame and is configured in a frustoconical shape generally corresponding to the configuration of the larger lampshade. The artwork on the additional frame is aligned with the art-work on the first frame which itself is aligned with the window opening on the lampshade. The two frames form a composite illustration having a three-dimensional effect as a result of the spacing between the frames. Additionally, since the lampshade is formed from a non-translucent material while the frames are translucent, the three-dimensional effect is further enhanced by illumination when the lighting source (e.g. lightbulb) within the lampshade is turned on. Moreover, in order to avoid distortion of the frustoconical configured frame mounted within the lampshade, the images on this frame are pre-distorted to compensate for the distortion which would otherwise occur as a result of the viewing window cut from the frustoconical configured lampshade.

A plurality of frustoconically shaped frames successively decreasing in diameter and spaced a predetermined distance apart from each other, may be mounted within the lampshade to enhance the three-dimensional effect provided by the display device.

Accordingly, the present invention provides a decorative lamp capable of providing a three-dimensional display of artwork or photographs which may be illuminated at the selection of the user, and which may be incorporated into a standard frustoconical configured lampshade without distortion of the resulting three-dimensional image.

BRIEF DESCRIPTION OF THE DRAWINGS

FIG. 1 is a perspective view of a standard lamp, with a lampshade partially cut away, incorporating the present invention;

FIG. 2 is a perspective view of a standard frustoconical configured lampshade having a viewing opening to be covered with a first panel of artwork in accordance with the present invention;

FIG. 3 is a perspective view of a second panel of artwork having a frustoconical configuration for mounting within the lampshade illustrated in FIG. 2;

DESCRIPTION OF THE PREFERRED EMBODIMENTS OF THE INVENTION

Figure 4:
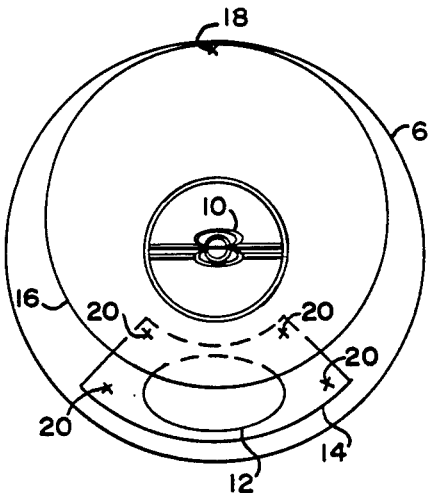
FIG. 4 is a bottom plan view of a lampshade showing first and second panels of artwork mounted inside the lampshade concentrically therewith.

In accordance with the objects of the present invention, a decorative lampshade is provided to create a three-dimensional effect for viewing artwork or other photographic material. The optical illusion of a third-dimension is created when a person views different panels of artwork spaced apart from each other and concentrically mounted within a non-translucent frustoconical lampshade having a viewing opening cut out therefrom. Light emitted from a standard lightbulb mounted at the center of the lampshade enhances the three-dimensional effect provided by the device by increasing the lighting contrast between the non-translucent lampshade and the viewing opening having translucent artwork mounted over it. The pleasing effect of the overall display may be further enhanced by mounting the interior artwork within the lampshade in a frustoconical configuration and pre-distorting that artwork to generally conform to the configuration of the lampshade and the viewing opening cut therein.

Referring first to FIG. 1 of the drawing, a standard electric lamp is illustrated by the reference numeral 2. The lamp 2 generally includes a base 4 and a frustoconical shaped, non-translucent, lampshade 6. A standard lightbulb 8 is mounted to the top of the base 2, and the lampshade itself is mounted to the lightbulb 8 by a pressure clamp 10 extending diametrically across the opened top of the lampshade 6.

As also illustrated partially in FIG. 1, a portion 12 of the lampshade has been cut out to provide an elliptical shaped viewing opening. A first frame of artwork 14 is mounted over the viewing opening by gluing the regions 20, which are proximate to the corners of the first frame, to the inner surface of the lampshade 6 in a manner such that the artwork on the first frame is displayed through the viewing opening. The frame 14 is mounted to the lampshade so that the curvature of the frame conforms identically to the curvature of the lampshade itself. The frame 14 is preferably formed from clear see-through acetate having an art motif such as a black silhouette, a white silhouette, or a multi-oolored print. A second panel of artwork 16 is configured in a frustoconical shape conforming generally to that of the lampshade 6, but being smaller in diameter so that the second panel may be mounted within the interior space defined by the lampshade. In particular, the frustoconically configured panel 16 is mounted to the inner surface of the lampshade 6 at a position on the lampshade diametrically opposed to the viewing opening 12. Preferably it is mounted to the portion of the inner surface of the lampshade along the linear surface designated by reference numeral 18 by glue or other adhesive means. The artwork on frame 16 is arranged so that the pictorial representation is centered with respect to the viewing opening 12 and in alignment with the artwork on the first frame 14 when frame 16 is mounted within the lampshade 6, as described above. Although frame 16 is generally similar in configuration to that of the lampshade 6, it is smaller in diameter so that it may be mounted within the lampshade spaced apart from but concentric with the first panel 14 which is flush against the inner surface of the lampshade. Preferably, the second panel 16 contains artwork printed on translucent paper or plastic to give an illusion of depth, as will be explained further below.

FIG. 2 of the drawing illustrates the lampshade 6 in further detail. It can be seen that the first frame of artwork 14 includes a black silhouette of a hunting dog in a field. It is mounted to the inner surface of the lampshade 6 so that the silhouette is displayed through a 45 degree elliptically shaped viewing aperture 12 cut out directly from the front of the lampshade 6. The corners of the frame 14 are mounted directly to the inner surface of the lampshade 6, approximate to the viewing opening 12, by glue or other suitable affixing means. The pressure clamp 10 removably secures the lampshade 6 to a lightbulb 8, as more clearly illustrated in FIG. 1, when the lampshade is mounted to the base.

FIG. 3 of the drawings illustrates the frustoconical configuration of the second frame of artwork 16. As illustrated, the artwork on this frame portrays a flock of ducks flying over a field and provides the background for the silhouette represented on frame 14. Accordingly, when the frame 16 is mounted within the lampshade 6 and spaced apart from, but in alignment with, the frame 14 and the viewing opening 12 on the lampshade, a three-dimensional composite effect is achieved. This effect is enhanced by the frustoconical nature of the panel 16 by which the upper portion of the artwork is tapered and appears to be at a further distance from the observer then the artwork displayed towards the larger diameter bottom portion of the frame 16.

Figure 7:
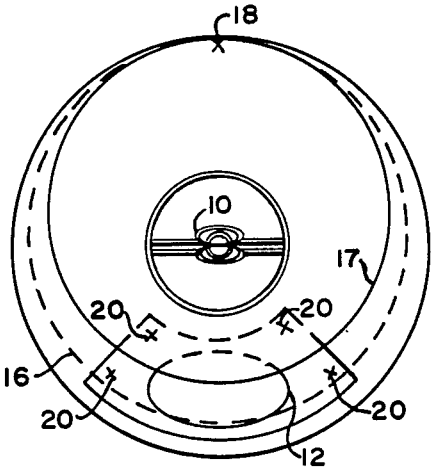
FIG. 7 is a bottom plan view of the lampshade similar to FIG. 4 except that a plurality of inner panels of artwork are mounted therein.

FIG. 4 of the drawings illustrates a bottom plan view of the lampshade 6 of the FIG. 2 in which both the first frame of artwork 14 and the second frustoconical panel of artwork 16 are mounted to the inner surface of the lampshade. The same references numerals are used to designate the same elements as in the previous drawing Figures. It can be seen from FIG. 4 that panels 14 and 16 containing the artwork forming the composite three-dimensional image are concentrically mounted with respect to the curvature of the lampshade 6 in the region proximate to the viewing opening 12. Although FIG. 4 illustrates a display having only a single frustoconical panel of artwork 16, FIG. 7 illustrates multiple inner panels of similar configuration having smaller diameters so that they may be successively mounted within the preceding panels. As illustrated in FIG. 7, frustoconically shaped panel 17 is concentrically mounted within the larger inner panel 16. The panel 17 is spaced apart from the panel 16 and is concentric with panel 16, panel 14 and the lampshade 6 near the viewing opening.

Figure 5:
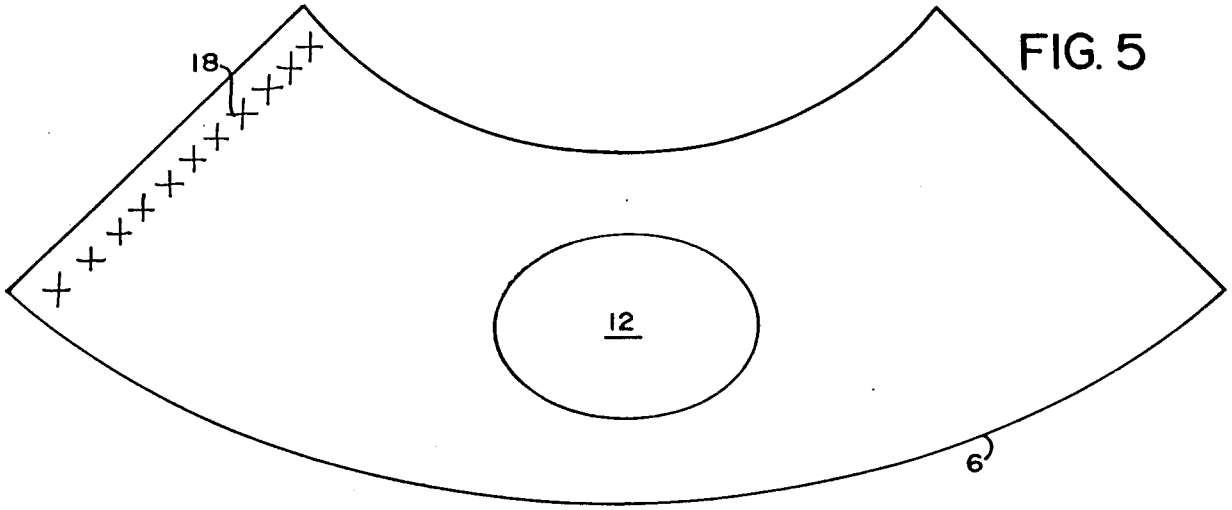
FIG. 5 is plan view of the lampshade illustrated in FIG. 2 in a flat, unfolded configuration.
Figure 6:
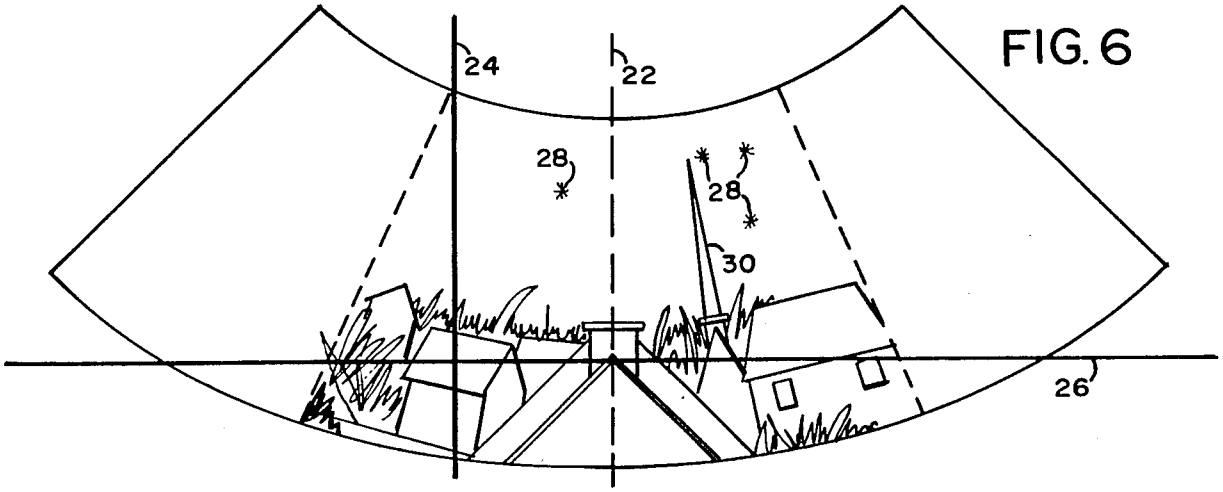
FIG. 6 is plan view of the second panel of artwork to be mounted within the lampshade shown in a flat, unfolded configuration to illustrate the pre-distortion of the artwork.

FIGS. 5 and 6 of the drawings illustrate the arcuate configuration of the frustoconical lampshade and the frustoconical panel of artwork 16 in an open, unfolded configuration. The general shape of these two elements are the same, but the artwork panel 16 is smaller in dimension since it must fit within the lampshade when both are in their solid configuration.

As noted above the panel 16, when mounted within the lampshade, is frustoconically shaped to enhance the three-dimensional effect provided by the composite display. In order to achieve this result, ordinary artwork cannot be used on frame 16 but the artwork must be anamorphic or predistorted to conform to the frustoconical configuration of the panel 16, the lampshade 6, and the viewing opening 12. As illustrated in FIG. 6, portions of the artwork on panel 16 intended to appear vertical with respect to the horizon are only actually vertical along a center line 22. To the left and the right of center line 22, illustrations intended to appear vertical when panel 16 is in a frustoconical configuration are in actuality acutely angled with respect to vertical line 24. Similarly, portions of the pictorial representation intended to appear to be horizontal when the frame 16 is in a frustoconical configuration are in reality only horizontal at the center of the frame 16. The portions of the pictorial material to the left and right of the center line 22 which are intended to appear horizontal when the frame is in a frustoconical configuration are in reality acutely angled relative to a horizontal line 26 when the frame 16 is flat, as shown in FIG. 6.

As evident from the above, existing artwork or photographs cannot be used on the panel 16, but only artwork specially prepared as described above will be satisfactory. The necessary pre-distortion of the artwork on the panel 16 is due to the general nature of the arc of curvature of the panel. All artwork must be prepared so that the horizon of the scene depicted follows the curving arc of the panel 16 as shown in FIG. 6. If this is not done, the horizon line of the artwork on panel 16 will bow down noticeably when the panel is folded into its frustoconical configuration. Likewise, all vertical representations, other than at the center of the panel 16 of FIG. 6, will appear to bend outwardly when the panel is folded in a frustoconical configuration unless these representations are pre-distorted on the flat panel as illustrated in FIG. 6.

As further illustrated in FIG. 6, pinholes 28 and slits 30 may be cut out of panel 16 to highlight and accentuate features of the drawing intended to be bright. This added illumination results because more light from the lightbulb passes through the pinholes and slits then it does through the other parts of the panel 16.

In summary, the present invention provides a display device comprising a decorative frustoconical shaped lampshade providing a display which creates a three-dimensional effect for viewing artwork or photographic illustrations. The three-dimensional effect results from a combination of several factors which include the frustoconical configuration of both the lampshade and the background panel of art to be displayed; the concentric, spaced apart, arrangement of the plurality of panels of artwork resulting in the composite display; the pre-distortion of the frustoconically shaped frame of artwork; and the contrast between the composite artwork depicted on different translucent frames and the non-translucent background provided by the non-translucent lampshade surrounding the viewing opening, this contrast being highlighted by illumination from the lightbulb centered within the lampshade.

The above description of the preferred embodiments of the invention is intended to be illustrative only, and not restrictive of the scope of the invention, that scope being defined by the following claims and all equivalents thereto.

We claim:

1. A decorative display device comprising:

an electric lamp comprising a base portion, a frustoconical configured lampshade mounted to said base portion, and illuminating means positioned within lampshade;

said frustoconical lampshade comprising a viewing opening cut out from a portion of said lampshade;

a first frame of material having a first pictorial representation thereon and mounted to cover said viewing opening for displaying said first ptictorial representation through said viewing opening; and at least a second frame of material having a second pictorial representation thereon and being configured in a frustoconical shape, said second frame being mounted within said lampshade so that said first and second pictorial representations are in alignment with each other and with said viewing opening, said first and second frames being spaced apart from each other and being mounted concentrically with respect to each other and with respect to the curavature of said lampshade proximate to said viewing opening and said second pictorial representation being predistorted when viewed flat such that it is substantially undistorted when viewed in said frustoconical shape.

2. The display device as claimed in claim 1 wherein said first frame is mounted to cover said viewing opening by affixing said frame directly to the inner surface of said lampshade proximate to said viewing opening, the curvature of said first frame confirming to the curvature of said lampshade at said viewing opening.

3. The display device as claimed in claim 1 wherein said first frame is formed from a transparent material.

4. The display device as claimed in claim 2 wherein said second frame is formed from a translucent material.

5. The display device as claimed in claim 1 further including a plurality of second frames having different pictorial representaations mounted eithin said lampshade, each of said plurality of second frames being configured in frustoconicol shapes having successively decreasing diameters in a direction towards the center of said lampshade so that each frame is mounted within the next larger frame, each of said plurality of second frames being spaced apart from each other and concentrically mounted with respect to each other and with respect to said lampshade proximate to said viewing opening, the pictorial representations on said second frames being predistorted as a foresaid.

6. The display device as claimed in claim 1 further including openings or slits defined in said second frame for highlighting selected portions of said second pictorial representation by increasing the intensity of light from said illuminating means passing through said openings and slits.

7. A three-dimensional display device comprising:

a frustoconical lampshade adapted to be mounted on a lamp having a source of illumination;

said frustoconical lampshade defining a viewing opening cut out from a portion thereof;

a first frame of material having a first pictorial representation thereon and mounted to cover said viewing openiong for displaying said first pictorial representation through said viewing opening; and at least a second frame of material having a second pictorial representation thereon and being configured in frustoconical shape, said second frame being mounted within said lampshade so that said first and second pictorial representations are in alignment with each other and with said viewing opening, said first and second frames being spaced apart from each other and mounted concentrically with respect to each other and with respect to the curvature of said lampshade proximate to said viewing opening and said second pictorial respresentation being predistorted when viewed flat such that it is substantially undistorted when viewed in said frustoconical shape.

8. The display device as claimed in claim 7 wherein said first frame is mounted to cover said viewing opening by affixing said frame directly to the inner surface of said lampshade proximate to said viewing opening, the curvature of said first frame conforming to the curvature of said lampshade at said viewing opening.

9. The display device as claime in claim 7 further including a plurality of second frames having a different pictorial representation mounted within said lampshade, each of said plurality of second frames being configured in frustoconical shapes having successively decreasing diameters in a direction towards the center of said lampshade so that each frame is mounted within the next larger frame, each of said plurality of second frames being spaced apart from each other and being concentrically mounted with respect to each ohter and with respect to said lampshade proximate to said viewing opening, the pictorial representations on said second frames being predistorted as aforesaid.

10. The display device as claimed in claim 7 further including openings or slits defined in said second frame for highlighting selected portions of said second pictorial representation by enabling a greater intensity of light to pass through said openings or slits than through other portions of said frame.

11. The display device as claimed in claim 7 wherein said first frame is formed from a transparent material.

12. The display device as claimed in claim 11 wherein said second frame is formed from a translucent material.

13. A decorative display device as claimed in claim 7 wherein said second frame of material is mounted to said lampshade along a straight line common to both.

14. A decorative display device as claimed in claim 9 wherein saud second frames of material are mounted to said lampshade along a straight line common to all.

15. A decorative display device as claimed in claim 7 wherein said predistortion comprises converting horizontal lines to circles about said frustoconical shape and vertical lines to lines intersecting tangents to said circles at right angles.

16. A decorative display device as claimed in claim 7 wherein said first pictorial representation comprises silhouette art and said second pictorial representation comprises opaque and translucent art.

17. A method of creating a three-dimensional effect for viewing artwork or photographic material, said method including the steps of:

cutting a viewing opening from a portion of a frustoconically shaped lampshade formed from a non-translucent material;

affixing a first frame of translucent material depicting a first pictorial representation thereon over said viewing opening for displaying said first pictorial representation through said viewing opening;

mounting a second frame of material configured in a frustoconical shape and depicting a second pictorial representation thereon within said lampshade such that said first and second pictorial representations are in alignment with each other and with said viewing opening, said first and second frames being spaced apart from each and mounted concentrically with respect to each other and with respect to the curvature of said lampshade proximate to said viewing opening and said second pictorial representation being predistorted when viewed flat such that it is substantially undistorted when viewed in said frustoconical shape.

18. The method of claim 17 wherein said first frame is mounted directly to the inner surface of said lampshade such that the curvature of said first frame conforms to the curvature of said lampshade.

19. The method of claim 17 further including the step of mounting a plurality of said second frames having different pictorial representation within said lampshade, each of said plurality of said second frames being configured in frustoconical shapes having successively decreasing diameters in a direction towards the center of said lampshade so that each of said frames is mounted within the next larger frame, each of said plurality of second frames being spaced apart from each other concentrically mounted with respect to each other and with respect to said lampshade proximate to said viewing opening, the pictorial representations on said second frames being predistorted as aforesaid.

20. The method as claimed in claim 17 including the step of providing illuminating means within said frustoconical lampshade for illuminating the first and second pictorial representation on said first and second frames.

21. The method of claim 20 including the step of defining slits or openings in selected portions of said pictorial representation depicted on said second frame so that said selected portions of said second pictorial representation are highlighted by said illuminating means illuminating means within said lampshade.

* * * * *